US008733647B2

(12) United States Patent
Roider et al.

(10) Patent No.: US 8,733,647 B2
(45) Date of Patent: May 27, 2014

(54) SIGHT

(75) Inventors: Konrad A. Roider, Mils (AT); Andreas Zimmermann, Fulpmes (AT)

(73) Assignee: Swarovski-Optik KG. (AT)

( * ) Notice: Subject to any disclaimer, the term of this patent is extended or adjusted under 35 U.S.C. 154(b) by 0 days.

(21) Appl. No.: 13/440,191

(22) Filed: Apr. 5, 2012

(65) Prior Publication Data

US 2012/0298749 A1 Nov. 29, 2012

(30) Foreign Application Priority Data

Apr. 6, 2011 (AT) ..... 490/2011

(51) Int. Cl.
*G06F 19/00* (2011.01)

(52) U.S. Cl.
USPC ..... 235/404

(58) Field of Classification Search
USPC ..... 235/400, 404, 413
See application file for complete search history.

(56) References Cited

U.S. PATENT DOCUMENTS 6,873,406 B1 3/2005 Hines et al.
8,033,464 B2 * 10/2011 Windauer et al. ..... 235/404

FOREIGN PATENT DOCUMENTS

DE 3933042 A1 6/1990
EP 2148165 A2 1/2010
WO 2006060489 A2 6/2006
WO 2007133277 A2 11/2007

OTHER PUBLICATIONS

M. Tschannen, "Aussenballistik: Flugbahn and Ziellinie", this document contains the compilation of a series of articles which appeared in the "Swiss weapon Magazine" from issue Mar. 2006 to Jan. 2007.
M. Tschannen, "Ballistik füden Feldgebrauch", the document contains the compilation of a series of articles which appeared in the "Swiss weapon Magazine" from issue Oct. 2003 to Feb. 2004.
M. Tschannen, "Statistische Methoden der Ballistik ", the document contains the compilation of a series of articles which appeared under the theme "Statistics for use in the field" in the "Swiss weapon Magazine" from issue Mar. 2004 to Aug. 2004.

* cited by examiner

*Primary Examiner* — Seung Lee
(74) *Attorney, Agent, or Firm* — Lerner, David, Littenberg, Krumholz & Mentlik, LLP

(57) ABSTRACT

The invention relates to a method of determining a replacement distance when taking aim on a target (2) with a target distance D (6) and an elevation angle α (5) between a line of sight (4) to the target (2) and a horizontal plane (3) with a weapon (9) in order to fire projectiles with an approximately flat trajectory. The replacement distance is determined from the target distance D (6) by means of a correction function, and the correction function is determined exclusively from non-ballistic characteristic values and at least as a function of the target distance D (6) and the difference in angle between the elevation angle α (5) and the shooting angle.

32 Claims, 3 Drawing Sheets

SIGHT

The invention relates to a method and a device for determining a replacement distance to be taken into account instead of the target distance when taking aim on a target with a sight of a firearm as outlined in the introductory parts of claims 1, 2, 3, 17, 23 and 27.

Sights, in particular sighting telescopes, are usually mounted on the weapon and used in conjunction with the latter to be zeroed. By weapons are meant weapons which fire a projectile directly at a target along an extended or slightly curved flight path. Shooting takes place from a fixed shooting distance of 100 m for example, with a horizontally oriented sighting line onto a target and using ammunition typical for the weapon (cartridge load). In order to compensate for the descent of the projectile on its flight path between the firearm and target, the axis at which the firearm extends is inclined by an angle of elevation relative to the sighting line of the sight. When zeroing the firearm, this angle of elevation is set so that the actual point of impact of the projectile coincides with the desired point of impact, i.e. the sighted target. In practical application, deviances from these zeroing conditions have to be taken into account in the case of a real shot. Influencing factors which change the ballistics are, for example, air pressure and air temperature, initial velocity and the coefficient of drag or ballistic coefficient of the shot, lateral movement of the firearm out of line or a shot angled up or down.

The deviance which occurs in the case of an angled shot is due to the changed direction of the projectile's movement relative to the direction of the force of gravity acting on the projectile. A comparison of the projectile's trajectory in the case of an angled shot and the projectile's trajectory in the case of a horizontally fired shot shows that the projectile trajectory of a shot fired at an angle extends slightly flatter relative to the sighting line. If the sighting line or holding point were directed onto the target in the same way as a horizontal shot, the result would be a so-called high shot. This can be prevented by reducing the angle of departure (elevation), i.e. the angle between the barrel axis and a horizontal plane. This is done either by reducing the angle of elevation (tangent elevation) or the elevation angle (angle of sight). This correction of the value of the angle of departure by means of which the sight is aligned relative to the target or the correction by means of which the sighting line is aligned on the target is tantamount to taking account of a replacement distance which is used instead of the actual target distance for sighting the target. This can also be explained by the concept of the equivalent horizontal distance E. This is important when using a so-called ballistic reticle (crosshairs), for example, and different vertical markings are provided in the reticle corresponding to the different zeroing ranges. If, in the case of firing a shot at an angle, the sight is set as if the target were not disposed at the actual distance D but in a same horizontal plane as the firearm at a target distance with a value corresponding to the equivalent horizontal distance, a point-blank shot is then also guaranteed. Another possible way of making allowance for the correction needed to the orientation of the firearm or sight for taking aim on the target is to adjust the height of the reticle (crosshairs) by means of the elevation turret of the sight so that it corresponds to the equivalent horizontal distance. On the other hand, modern sights are known, which have integrated ballistics calculators and display the requisite corrections either numerically or in the form of variable holding points.

What all of these options have in common is that it is necessary, by whatever method in the most acceptable way, to determine or calculate the correction needed when firing a shot at an angle. Accordingly, the objective of this invention is to specify a method and a device by means of which a simpler way of ensuring that a high accuracy of aim is achieved when taking a shot fired at an angle with a firearm is obtained.

To provide a clearer understanding, the invention will be explained in more detail with reference to the appended drawings.

These are highly schematic, simplified diagrams illustrating the following:

Figure 1:
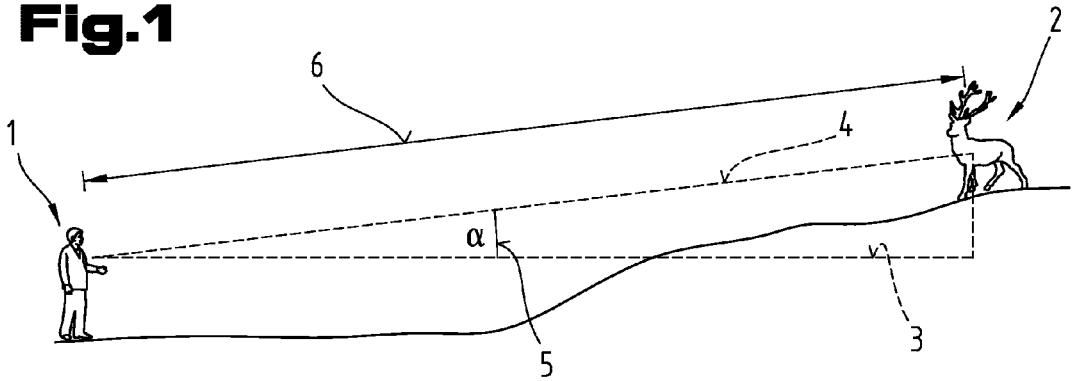
FIG. 1 shows a relative spatial arrangement showing a marksman taking a shot fired at an angle onto a target disposed in a higher position.

Firstly, it should be pointed out that the same parts described in the different embodiments are denoted by the same reference numbers and the same component names and the disclosures made throughout the description can be transposed in terms of meaning to same parts bearing the same reference numbers or same component names. Furthermore, the positions chosen for the purposes of the description, such as top, bottom, side, etc., relate to the drawing specifically being described and can be transposed in terms of meaning to a new position when another position is being described. Individual features or combinations of features from the different embodiments illustrated and described may be construed as independent inventive solutions or solutions proposed by the invention in their own right.

All the figures relating to ranges of values in the description should be construed as meaning that they include any and all part-ranges, in which case, for example, the range of 1 to 10 should be understood as including all part-ranges starting from the lower limit of 1 to the upper limit of 10, i.e. all part-ranges starting with a lower limit of 1 or more and ending with an upper limit of 10 or less, e.g. 1 to 1.7, or 3.2 to 8.1 or 5.5 to 10.

FIG. 1 illustrates the relative spatial arrangement in the situation of a marksman 1 firing a shot upwards at an angle onto a target 2. The target 2 in this instance is disposed in a position higher than a horizontal plane 3 assigned to the marksman 1. A line of sight 4 or sighting line between the marksman 1 and the target 2 therefore subtends with the horizontal plane 3 a so-called elevation angle (angle of sight) a 5. The length of the line of sight 4 or the distance between the marksman 1 and the target 2 also defines a distance D 6. When taking aim on the target 2 with a firearm 9 (FIG. 2), the marksman 1 must therefore also make allowance for the elevation angle $\alpha$ 5 in addition to the target distance D 6. To do this, however, it is not enough for the marksman simply to pivot the firearm upwards by the elevation angle $\alpha$ 5 and align a target mark (FIG. 3) with the target 2, which corresponds precisely to the target distance D 6. In fact, a correction still has to be taken into account, the reason for this being that a trajectory 7 of a projectile in the case of a projectile fired at an angle has less curvature relative to the sighting line than is the case with a horizontal shot.

Figure 2:
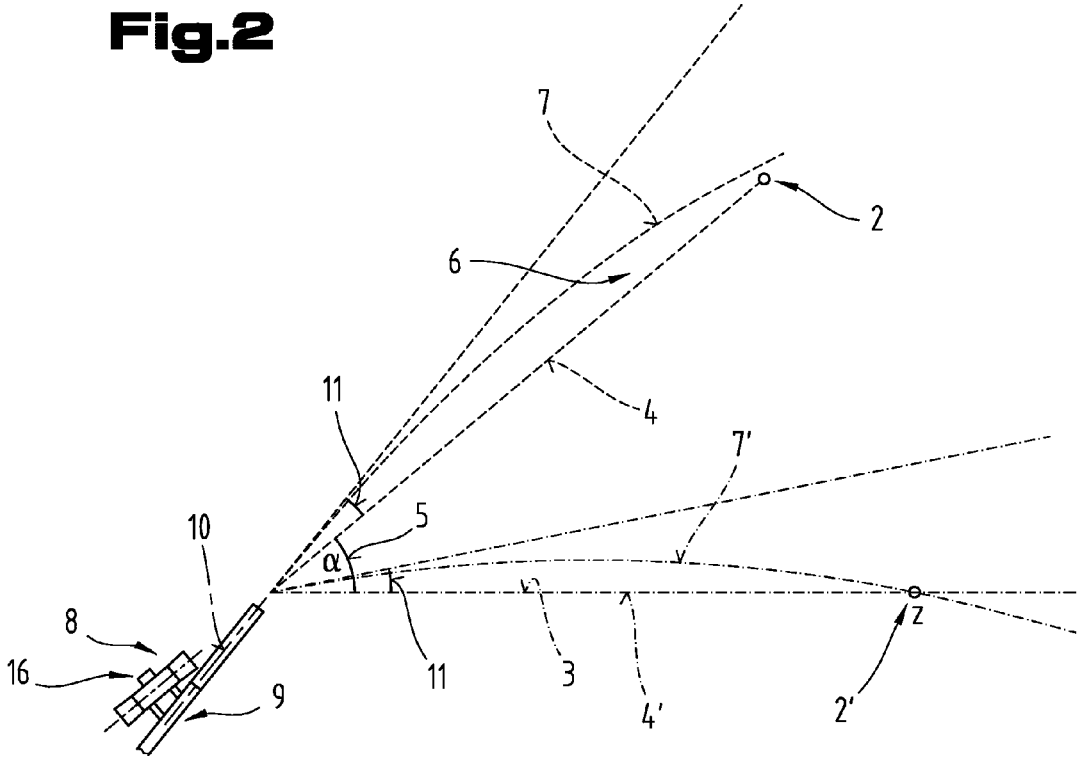
FIG. 2 shows a comparison of the trajectories of a projectile when the target is sighted during an angled shot and during a horizontal shot.

FIG. 2 illustrates the trajectory 7 of a projectile when taking aim on the target 2 with a sight 8 of a firearm 9 for a shot fired upwards at an angle at the elevation angle α 5. In order to illustrate the effect of the elevation angle α 5 on the trajectory 7, a horizontal shot onto a target 2' is also illustrated in FIG. 2. For the sake of simplicity, it should be assumed that the value of the target distance D 6 to the target 2' respectively to the target 2 is equal to the zeroing range of the firearm 9.

A barrel axis 10 of the firearm 9 is pivoted relative to the sighting line or line of sight 4 of the sight 8 by an angle of elevation 11. This angle of elevation 11 is adjusted when zeroing the firearm 9 so that the trajectory 7' of the projectile intersects the horizontal plane 3 in the zeroing range. This precisely satisfies the zeroing condition whereby the actual point of impact of the projectile coincides with the desired point of impact of the target 2' disposed in the zeroing range.

Zeroing the firearm 9 takes place in the usual way in that a series of shots are fired onto a target Z disposed within the zeroing range. In other words, the distance between the location of the marksman 1 or muzzle of the firearm 9 and the target Z is selected so that it is equal to the zeroing range, and the muzzle of the firearm 9 and the target Z are disposed in the same horizontal plane 3. If a deviance of the point of impact of the projectile from the target Z is ascertained after firing a shot at the target Z, a change must be made to the relative position between the line of sight 4 and the barrel axis 10 of the firearm 9, the intention being to ensure that the point of impact of the projectile when another shot is fired lies closer to the target Z. Such a change to the relative position of the line of sight 4 relative to the barrel axis 10 of the weapon 9 is usually undertaken by making an adjustment to an elevation turret 16 of the sight 8 or a telescopic sight, as a result of which the path of the line of sight 4 through the visual optical path of the sight 8 will be changed. By making such a change, both variances of the point of impact of the projectile from the target Z in the horizontal and in the vertical direction can be compensated. In order to reduce a variance in the vertical direction, the angle of elevation 11 will be changed when such an adjustment is made on the elevation turret 16. In order to zero the firearm 9, the series of test shots and readjustments of the relative position of the line of sight 4 relative to the barrel axis 10 of the weapon 9 is continued until a sufficiently high accuracy of aim is obtained.

Based on a more generalized approach, the firearm 9 is zeroed at a zeroing angle that is inclined by a pre-defined value relative to the horizontal plane 3. This can be of practical advantage in the case of a firearm 9 which is regularly fired from a high-point across an otherwise flat, horizontal terrain. For such an application, the firearm 9 can be zeroed at a pre-selected zeroing angle with a negative value. This is again done by continuing with a series of test shots from the firearm 9 and making readjustments to the relative position of the line of sight 4 relative to the barrel axis 10 of the weapon 9 until a sufficiently high accuracy of aim is obtained.

If the firearm 9 is then directed onto the target 2 disposed higher above the horizontal plane 3 and in addition the sighting line or line of sight 4 of the sight 8 is focused on the target 2, a change in the trajectory of a projectile fired with the firearm 9 must be taken into account, and the trajectory 7 of the projectile will now be slightly flatter relative to the sighting line, in other words will have a less pronounced curvature than in the case of the horizontal shot with trajectory 7'. Trajectory 7 above is therefore incorrect for the target 2. This error can be corrected by pivoting the firearm 9 slightly towards the horizontal plane 3 so that the original sighting line or line of sight 4 is directed onto a point lying below the target 2 and the line of sight 4 subtends an angle with the horizontal plane 3, the value of which is smaller than the value of the elevation angle α 5. Such a correction will be described below with reference to FIG. 3.

In the situation using a firearm 9 zeroed at a zeroing angle that is inclined—relative to the horizontal plane 3—what must be taken into account for this correction or correction function instead of the elevation angle α 5 is the difference in angle between the elevation angle α 5 and the zeroing angle.

Figure 3:
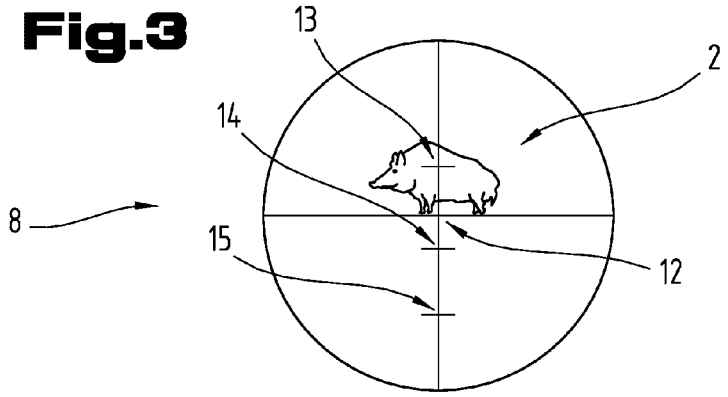
FIG. 3 shows an image viewed through a sight when sighting the target as illustrated in FIG. 2.

FIG. 3 shows an image looking through the sight 8 when sighting target 2 illustrated in FIG. 2.

In this example of an embodiment, the sight 8 has a target marking arrangement with crosshairs 12 and additional target marks 13, 14 and 15 auf. The disposition of the image of the target 2 relative to the crosshairs 12 and target marks 13, 14, 15 corresponds to that of the situation in which allowance has already been made for the correction explained above. The line of sight 4 of the sight 8—it corresponds to the intersection point of the crosshairs 12—is focused on a point below the target 2. Accordingly, the image of the target 2 appears above the crosshairs 12—in this case moved so as to coincide with the target mark 13.

On the other hand, the image illustrated in FIG. 3 may also be interpreted in connection with the situation of a horizontal shot where the target 2 is disposed in the same horizontal plane 3 as the firearm 9. As illustrated, the target mark 13 disposed above the crosshairs 12 is focused on the target and can therefore only be hit by the projectile if its distance from the firearm 9 is shorter than the zeroing range (corresponding to crosshairs 12). For horizontal shots, therefore, the target mark 13, crosshairs 12, target mark 14 and target mark 15 can be assigned different values of the target distance D 6. The values of the target distance D 6 effectively increase in the same sequence (target mark 13, crosshairs 12, target mark 14 and target mark 15). This could be done in the context of a calibration of the target mark arrangement with corresponding target distances D 6, for example.

The values of the target distance D 6 assigned to target marks 13, 14, 15 and the crosshairs 12 for horizontal shots are now also of importance in the case of shots fired at an angle with an elevation angle α 5, however, insofar as they are used as so-called equivalent horizontal distances E in order to make allowance for the correction to the orientation of the firearm 9 or line of sight 4 of the sight 8 onto the target 2 described above. Accordingly, the marksman 1 uses a replacement distance when taking aim instead of the value of the actual target distance D 6.

It is therefore of decisive importance to be able to quantitatively determine the requisite correction. A rule of thumb known as the "Rifleman's Rule" has long been used for this purpose, whereby the target distance D 6 is multiplied by the cosine of the elevation angles α 5 in order to obtain the value of the equivalent horizontal distance E.

$$E = D \times \cos(\alpha) \qquad \text{Equation 1}$$

For a shot fired at an angle from an elevation angle α 5, if the sight 8 is adjusted as if the target 2 were in the same horizontal plane 3 as the firearm 9 and within the equivalent horizontal distance E, it can be guaranteed that the target 2 will be hit (a point-blank shot).

However, the calculation by which the equivalent horizontal distance E is determined using the Rifleman's Rule in the form of equation 1 specified above is only an approximation and will only deliver sufficiently accurate results for relatively short target distances D 6 and low values for the elevation angle α 5.

Calculating the equivalent horizontal distance E on the basis of equation 1 can also be interpreted as a modification to the target distance D 6 by a correction factor KF which depends on only the elevation angle α 5 in the case of the Rifleman's Rule.

$$E=D\times KF \quad \text{Equation 2}$$

$$KF=KF(\alpha)=\cos(\alpha) \quad \text{Equation 3}$$

There are already ballistic programs (e.g. QuickTARGET, EXBAL, Sierra Infinity) known from the prior art, as well as sight or distance measuring systems with integrated ballistic calculators, which take account of environmental factors such as temperature, air humidity, wind strength and air pressure, but also in particular data pertaining to the cartridge load or ammunition, used as a means of determining the correction or correction factor KF. Such devices enable the correction to be taken into account either by numerically specifying the equivalent horizontal distance E or by providing a display of a variable holding point (i.e. variable target marks 13, 14, 15). A correction factor KF which depends on several parameters is therefore used.

$$KF=KF(D,\alpha,\text{cartridge load}, \ldots) \quad \text{Equation. 4}$$

Figure 4:
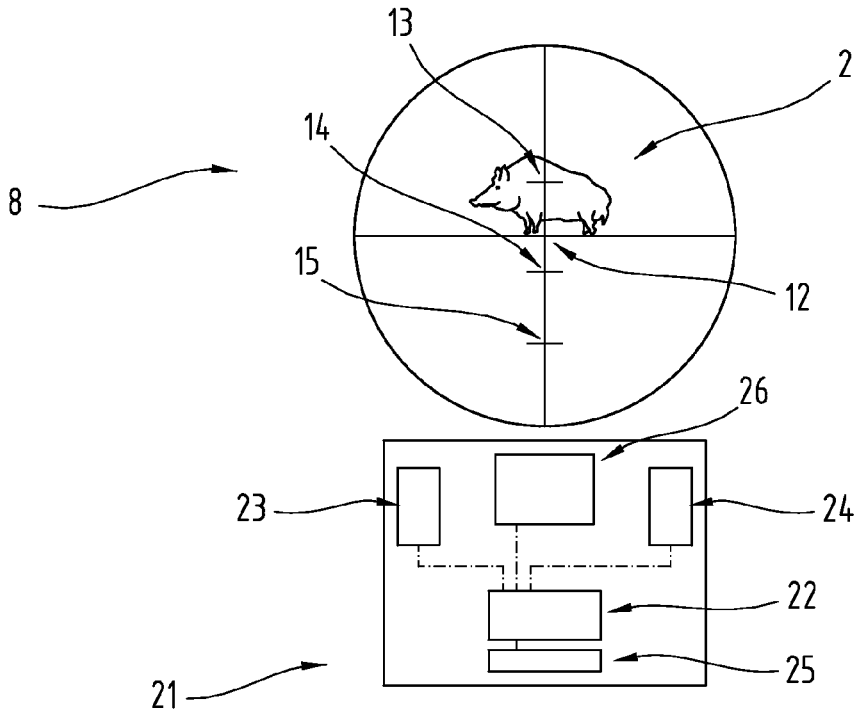
FIG. 4 shows a device for determining the equivalent horizontal distance E looking through a sight of the type illustrated in FIG. 3.

One possible way of implementing the method proposed by the invention for determining an equivalent horizontal distance E so as to take aim at a target 2 with a sight 8 of a firearm 9 will be explained with reference to FIG. 4. For this purpose, a device 21 for determining the equivalent horizontal distance E is provided, which is preferably equipped with a central microprocessor 22 for automatically running the method. This device 21 comprises a distance meter 23 for measuring the target distance D 6 and an inclination sensor 24 for measuring the elevation angles α 5 at which the target 2 appears to the marksman 1. Using the value to the target distance D 6 and the elevation angle α 5, the microprocessor 22 is able to calculate a corresponding correction without taking any other data into account. However, previously determined correction factors KF may also be stored in a memory 25 In order to simplify and/or speed up the process so that the microprocessor 22 can run a calculation of the equivalent horizontal distance E by correlating the measurement signals received from the distance meter 23 and from the inclination sensor 24. The result of the calculation is presented on a display 26. By selecting the target mark corresponding to the displayed equivalent horizontal distance E (based on this example of an embodiment, target mark 13), the marksman 1 can then align the firearm 9 or sight 8 on the target 2 or change the angle of elevation by making an adjustment on the elevation turret in keeping with the displayed equivalent horizontal distance E and fire a shot.

The device 21 for determining the equivalent horizontal distance E may be a separate device from the firearm 9 or sight but may alternatively also be part of the firearm 9 or sight 8. In the latter case, the display 26 of the device 21 is preferably integrated in the optical path of the sight 8. To this end, the display 26 is faded into one of the image planes of the optical system of the sight 8 so that the value of the calculated equivalent horizontal distance E appears in the same visual field as that displayed to the marksman 1 by the sight 8.

Based on an alternative design comprising a combination of the device 21 with a sight 8, instead of a numerical display of the equivalent horizontal distance E on the display 26 by the microprocessor 22, a variable holding point is calculated and automatically faded into the optical path of the sight 8, i.e. a correspondingly positioned target mark 13, 14, 15 is displayed. However, it would also be conceivable to make allowance for the requisite correction factor by means of an automatic (motorized) mechanical adjustment of the elevation turret or an adjustment of the sighting line by moving an optical element in the optical path of the sight.

Also of advantage is an embodiment of the sight 8 in which the distance meter 23 is at least partially integrated in the optical path of the sight 8. This can be achieved—for example where the distance meter 23 is provided in the form of a laser distance meter—if the laser beam emitted to the target 2 and/or the laser light reflected by the target 2 runs through the objective of the sight 8.

Based on the method of determining the equivalent horizontal distance E proposed by the invention, the latter is calculated using a correction based on a pair of values representing a value for the target distance D 6 and a value for the elevation angle α 5. Surprisingly, it has been demonstrated that the advantages of the methods described above can be (simply and accurately) linked to a correction determined solely for different values of target distances D 6 and different values of elevation angles α 5, and can be so without having to contend with any of the disadvantages (namely, the fact that it is necessary to know the ballistic cartridge load data and the fact of being constrained to short distances and small elevation angles). A sufficiently accurate calculation of the equivalent horizontal distance E for taking aim at the target 2 is therefore possible. The method of determining the equivalent horizontal distance E proposed by the invention is therefore based on correction factors KF for which the following applies:

$$KF=KF(D,\alpha) \quad \text{Equation 5}$$

Based on a first example of an embodiment, the following correction factor is used.

TABLE 1

| | $\alpha_1$ | $\alpha_2$ | $\alpha_3$ |
|---|---|---|---|
| $D_1$ | $KF_{11}$ | $KF_{12}$ | $KF_{13}$ |
| $D_2$ | $KF_{21}$ | $KF_{22}$ | $KF_{23}$ |
| $D_3$ | $KF_{31}$ | $KF_{32}$ | $KF_{33}$ |

Correction factors KF, can be assigned to pairs of values ($D_i$, $a_j$) after carrying out corresponding test shots, for example.

Figure 5:
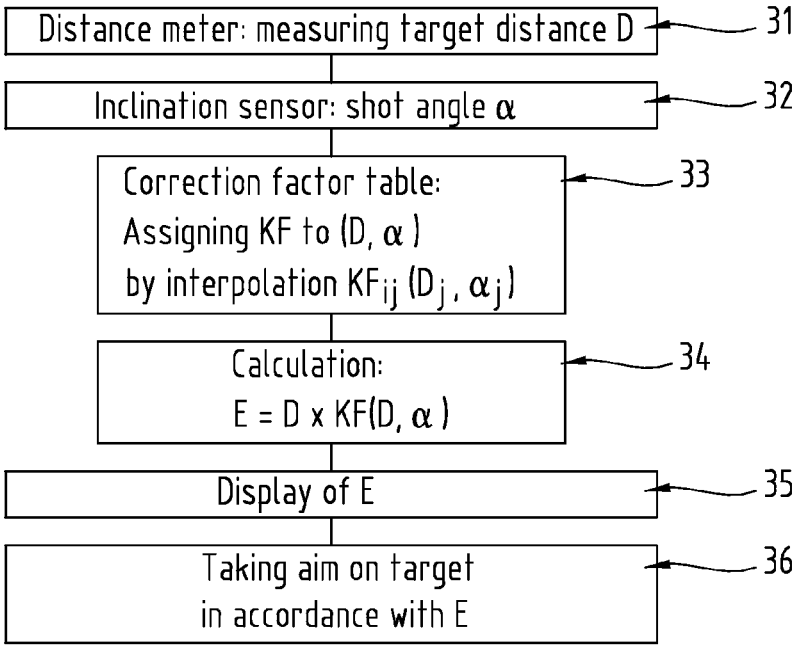
FIG. 5 is a flow chart illustrating the method steps of the method for determining the equivalent horizontal distance E.

FIG. 5 is a flow diagram illustrating the method steps used for the method of determining the equivalent horizontal distance E proposed by the invention for taking aim at the target 2 with the sight 8 of the firearm 9. In a first step 31, the target distance D 6 is measured with the aid of the distance meter 23. In another method step 32, the elevation angle α 5 is determined with the aid of the inclination sensor 24. However, method steps 31 and 32 may also take place simultaneously. If the device 21 (FIG. 4) is of the type where it is structurally connected to or integrated with the sight 8 or firearm 9, these measurements are taken by aligning the sight 8 with the crosshairs 12 on the target 2 and the marksman 1 then initiates the measuring operation in accordance with method steps 31 and 32. The correction can therefore be determined automatically in a subsequent method step 33 by means of the microprocessor 22 on the basis of the measurement values obtained for the target distance D 6 and elevation angle α 5. This is preferably done by means of the microprocessor 22, which determines the correction factor KF corresponding to the measurement values from a correction factor table. In order to simplify the correction factor table or keep it small, an interpolation based on correlations of the correction factors $KF(D_i, a_j)$ could conceivably be run, thereby correlating the actual values for the target distance D 6 and elevation angle α 5 obtained from the measurements with a corresponding value for the correction factor KF(D, α). In a subsequent method step 34, the microprocessor 22 then runs the calculation of the equivalent horizontal distance E by multiplying the target distance D 6 by the previously determined value of the correction factor KF(D, α) so that finally, in the following method step 35, this value of the equivalent horizontal distance E can be presented on the display 26 of the device 21. In another method step 36, the marksman 1 is then able to take aim at the target 2 whilst taking account of this value of the equivalent horizontal distance E and trigger a shot at the target 2.

Based on another embodiment of the method proposed by the invention, commercially available ballistics programs are used to determine the correction factor table. Using commercially available ballistics software, it is possible to calculate parameters for trajectories 7 corresponding to ammunition and cartridge loads for both horizontal shots and shots fired at an angle, which can be selected and set, and thus calculate the condition for a point-blank shot, such as the angle of elevation or the requisite adjustment of the elevation turret of the sight 8. One result of such a calculation is that the equivalent horizontal distance E is also determined. Examples of such commercially available ballistics programs are QuickTARGET by H. Brömel—DE, EXBAL by Perry Systems—USA or Sierra Bullets Infinity Exterior Ballistics Software by Sierra—USA.

Evaluating ballistic calculations with commercially available ballistic programs also enables correction factors to be determined for different cartridge loads and ammunition types (see equation 4). Based on this example of an embodiment of the invention, in order to determine the values of the correction factors $KF(D_i, \alpha_j)$ of the correction factor table with a ballistics program, values for the correction factors KF are calculated from data pertaining to the cartridge load of a type of ammunition and a mean value is worked out from values of correction factors KF to different respective cartridge loads. The elements $KF_{ij}$ of the correction factor table thus form a two-dimensional matrix, and these correction factors $KF_{ij}=KF(D_i, \alpha_j)$ are calculated as follows:

$$KF_{ij} = \frac{1}{n}\sum_{l=1}^{n} KF(D_i, \alpha_j, \text{Cartridge } load_l) \qquad \text{Equation 6}$$

In the example of determining the correction factor table that will be described below, the ballistics software QuickTARGET was used and the trajectories 7 for three different ammunition types and cartridge loads were calculated for elevation angles α 5 with values of 15° and 35° and hence correction factors $KF_{ij}$ with a view to determining the equivalent horizontal distance E. The calculations were made respectively on the basis of the three ammunition types and cartridge loads set out in the table below. Column BC lists the ballistic coefficient and column $v_0$ the muzzle velocity (exit velocity) of the cartridge in m/s (meters/second).

| Name | BC | $v_0$ [m/s] |
|---|---|---|
| .308 WIN HMK | 0.356 | 780 |
| .300 WIN MAG | 0.421 | 935 |
| 7x57 R TMR | 0.255 | 780 |

Having determined the values of the correction factors KF ($D_i$, $\alpha_j$, cartridge load), equation 6 was then applied, i.e. a mean value was determined, in order to ascertain the elements $KF_{ij}$ of the correction factor table, as set out in the table below.

Correction factor table 2:

| D [m] | 10° | 30° |
|---|---|---|
| 100 | 0.986 | 0.876 |
| 200 | 0.987 | 0.884 |
| 300 | 0.989 | 0.893 |
| 400 | 0.990 | 0.902 |
| 500 | 0.991 | 0.910 |

To apply the method proposed by the invention, it is sufficient to store the correction factor table thus obtained in the memory 25 of the device 21 (FIG. 4) and hold it available for determining the equivalent horizontal distance E. Surprisingly, it has been found that equivalent horizontal distances E can be determined using a correction factor table, where the correction factors KF are dependent on only the target distance D 6 and elevation angle α 5. This is the case even though the absolutes flight paths, i.e. the trajectories 7, are dependent to a relatively high degree on the data pertaining to the cartridge load of the different types of ammunition. The cartridge loads/ammunition types chosen for this example cover a relatively broad range of cartridge loads and on the basis of the determined correction factors $KF_{ij}$ deliver a mean value for very different types of ammunition. For example, the cartridge load 0.300 WIN MAG has a very flat trajectory 7 and is therefore suitable for taking long shots. By contrast, the 7×57 R TMR has a relatively pronounced curved trajectory 7 and is therefore only suitable for short target distances D 6. The cartridge load 0.308 WIN HMK, finally, falls between the two mentioned above.

In the case of the ammunition types and cartridge loads used in this example of an embodiment, they are generally those which exhibit a very flat flight path or trajectory 7' for the shot, such as used for taking direct shots or direct firing. A high flatness number is characteristic of these types of ammunition. This means that when taking a horizontal shot, high values occur in terms of the quotient derived from the target distance D 6 and the distance between the highest point of the trajectory 7' and the line of sight 4' (FIG. 2). The method proposed by the invention is advantageously suitable for ammunition types and cartridge loads used for taking a direct shot with a flatness number with a value in the range of more than 100, preferably with a value in the range of more than 300.

Based on another embodiment of the method proposed by the invention, rather than deriving a mean value using equation 6, a weighted average value is used. To this end, contributions by cartridge loads with a flatter trajectory 7 for longer ranges or contributions by cartridge loads with a high flatness number are preferably given a higher weighting and contributions by cartridge loads with a more pronounced curved trajectory 7 or with a lower flatness number are given a lower weighting.

A more detailed explanation will now be given with reference to the diagrams in FIGS. 6 and 7 as to how a shot is fired at an angle using the method proposed by the invention.

Figure 6:
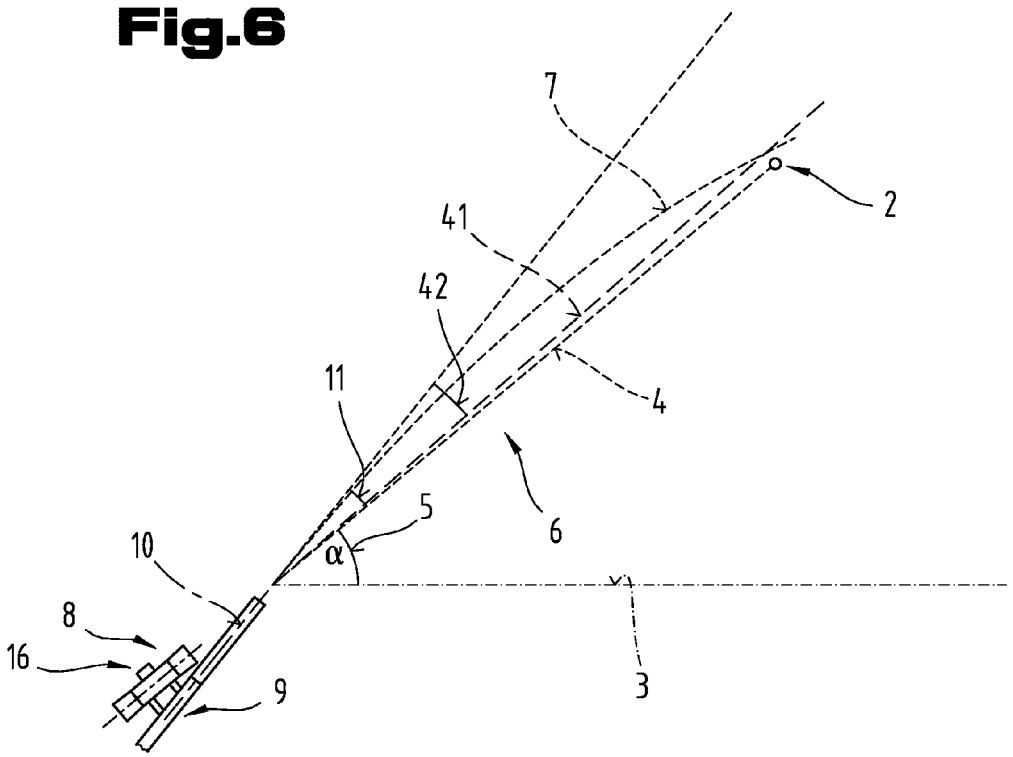
FIG. 6 illustrates the sighting of a target with the sight of a firearm.
Figure 7:
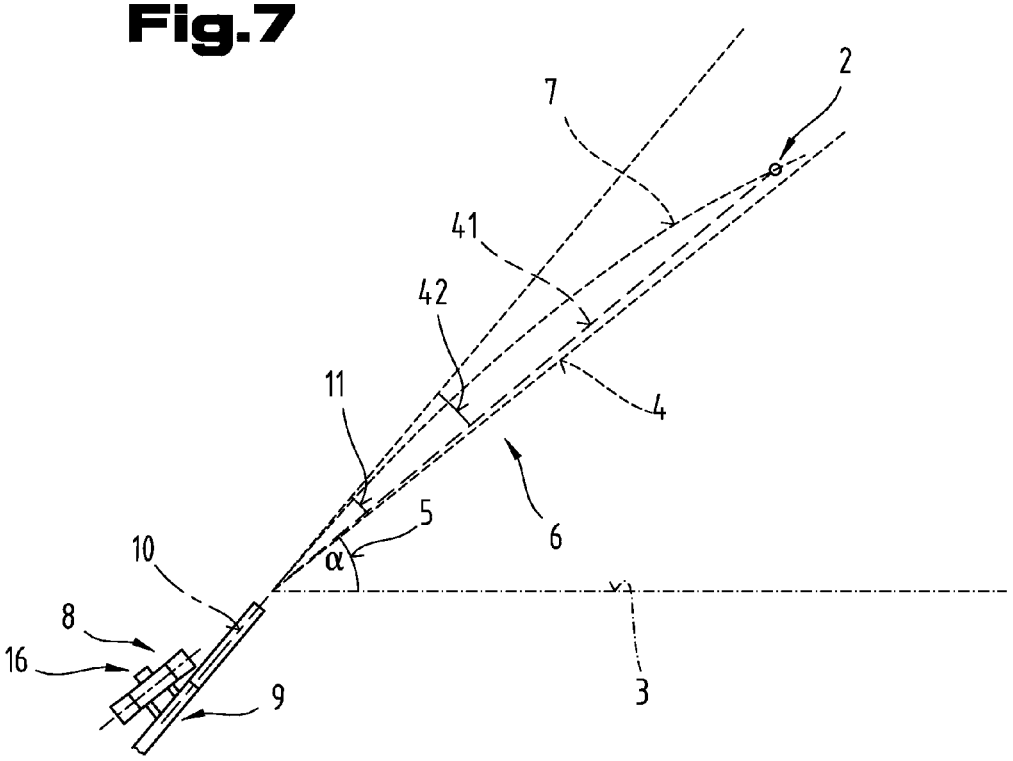
FIG. 7 illustrates the sighting of the target illustrated in FIG. 6 taking account of the correction proposed by the invention.

The diagram in FIG. 6 shows aim being taken on the target 2 with the sight 8 with the relative position of the line of sight 4 through the visual optical path of the sight 8 relative to the barrel axis 10 of the firearm 9—this being unchanged after zeroing the firearm 9. As already explained above in the description relating to FIG. 2, this situation results in a change in the trajectory 7 of the projectile with a slightly flatter trajectory relative to the line of sight 4 and the target 2 would be missed from above. As proposed by the method, a shot would not be fired at the target 2 in this situation and instead, the marksman 1 would activate the device 21 (FIG. 4) whilst holding the crosshairs 12 aligned on the target 2. This therefore triggers the measurement of the target distance D 6 by the distance meter 23 and the measurement of the elevation angle α 5 by the inclination sensor 24. On the basis of the measurement values obtained in this manner, the equivalent horizontal distance E is then determined in the microprocessor 22 of the device 21, which is then presented on the display 26. If using a sight with several target marks 13, 14, 15 as illustrated in FIG. 4, the marksman 1 will then choose the target mark corresponding to the displayed equivalent horizontal distance E. This is tantamount to selecting a new sighting line 41 that is different from line of sight 4 which, with the barrel axis 10 of the weapon 9, subtends a smaller angle 42 relative to the angle of elevation 11.

The marksman 1 then has the option of lining up the sighting line 42 on the target 2. To this end, the weapon 9 is pivoted by the marksman 1 to the degree that the sighting line 41 constitutes the new line of sight on the target 2, as a result of which the flight path of the projectile will be changed so that it assumes trajectory 7 onto the target 2. The barrel axis 10 of the weapon 9 illustrated in FIG. 7 has therefore been pivoted from the position illustrated in FIG. 6 by an angle corresponding to the difference between the angle of elevation 11 and the new angle of elevation 42.

Based on an alternative embodiment, the alignment of the firearm 9 onto the target 2 is corrected by an adaptation with the aid of an adjustment of the elevation turret 16 of the sight 8. The relative position between the line of sight 4 of the sight 8 and the barrel axis 10 of the weapon 9 is obtained by directly changing the angle of elevation 11 with the aid of the elevation turret 16. This means that in order to aim on the target 2 in both situations, the same crosshairs 12 (FIG. 4) are moved onto the target 2. As a consequence of this, the weapon 9 in this variant of the method is also pivoted by the marksman 1 by an angle corresponding to the value of the difference between the original angle of elevation 11 and the new, altered angle of elevation 42, so as to ensure that the target 2 will be reliably hit when a shot is fired. The described adjustment on the elevation turret 16 to change the relative position between the line of sight 4 extending through the visual optical path of the sight 8 and the barrel axis 10 of the weapon 9 can be done by the marksman 1 manually but it is advantageously done automatically, for example on the basis of an adjustment driven by en electric motor.

The correction needed when taking aim on target 2 when firing a shot at an angle can therefore be made using a method of determining a replacement distance between a location of a marksman 1 and a point of impact of a projectile in the horizontal plane 3. The replacement distance is then taken into account instead of the target distance D 6 when the marksman 1 is taking aim. This firstly requires the weapon 9 to be zeroed beforehand, and the relative position of the line of sight 4 through the visual optical path of the sight 8 or sighting telescope relative to the barrel axis 10 of the weapon 9 is set so that for a pre-definable projectile and a pre-definable zeroing range for horizontal shots, a desired high accuracy of aim is achieved. When taking a shot fired at an angle, the target distance D 6 between the location and the target 2 disposed on the line of sight 4 is determined along with the elevation angle α 5 subtended by the line of sight 4 and the horizontal plane 3. Based exclusively on non-ballistic characteristic values, the resultant target distance D 6 and the elevation angle α 5, a correction function is then determined. By applying the correction function to the measured value of the target distance D 6, the value of a replacement distance in a horizontal plane 3 is then determined. This value of the replacement distance is then applied as a means of determining the relative position between the line of sight 4 and the barrel axis 10 of the weapon 9 in order to change the previously determined target distance and arrive at the determined replacement distance. The correction function is preferably run using correction factors KF from a correction factor table, in which a value of the correction factor KF is assigned respectively to a pair of values representing a value for the target distance D 6 and a value of the shot angle α 5.

The embodiments illustrated as examples represent possible variants of the method and the device for determining an equivalent horizontal distance, and it should be pointed out at this stage that the invention is not specifically limited to the variants specifically illustrated, and instead the individual variants may be used in different combinations with one another and these possible variations lie within the reach of the person skilled in this technical field given the disclosed technical teaching. Accordingly, all conceivable variants which can be obtained by combining individual details of the variants described and illustrated are possible and fall within the scope of the invention. For the sake of good order, finally, it should be pointed out that, in order to provide a clearer understanding of the structure of the device for determining an equivalent horizontal distance, it and its constituent parts are illustrated to a certain extent out of scale and/or on an enlarged scale and/or on a reduced scale.

The objective underlying the independent inventive solutions may be found in the description. Above all, the individual embodiments of the subject matter illustrated in FIGS. 1, 2, 3, 4, 5, 6 and 7 constitute independent solutions proposed by the invention in their own right. The objectives and associated solutions proposed by the invention may be found in the detailed descriptions of these drawings.

LIST OF REFERENCE NUMBERS

1 Marksman
2 Target
3 Horizontal plane
4 Line of sight
5 Elevation angle α
6 Target distance D
7 Trajectory
8 Sight
9 Firearm
10 Barrel axis
11 Angle of elevation
12 Crosshairs
13 Target mark
14 Target mark
15 Target mark
16 Elevation turret
17
18
19
20
21 Device
22 Microprocessor
23 Distance meter
24 Inclination sensor
25 Memory
26 Display 27
28
29
30
31 Method step
32 Method step
33 Method step
34 Method step
35 Method step
36 Method step
37
38
39
40
41 Sighting line
42 Angle

The invention claimed is:

1. A method of determining a replacement distance to be taken into account instead of the target distance D when taking aim on a target with a target distance D and an elevation angle α between a line of sight to the target and a horizontal plane from a weapon which has been zeroed at a zeroing angle that is different from the elevation angle α with a view to firing projectiles with an approximately flat trajectory, wherein the replacement distance is determined by applying a correction function to the target distance D wherein the correction function is not dependent on the ballistic coefficient and the muzzle velocity of the used ammunition, rather the correction function is dependent on the target distance D and the difference in angle between the elevation angle α and the zeroing angle.

2. The method according to claim 1, wherein a flatness number of the projectile has a value greater than 100.

3. The method according to claim 1, wherein an equivalent horizontal distance E is determined as the replacement distance by applying the correction function to the target distance D, and a value for the degree of correction is assigned respectively to a pair of values ($D_i$, $\alpha_j$) representing a value of the target distance D and a value representing the elevation angle α.

4. The method according to claim 1, wherein a correction factor KF is used as the correction function, and the equivalent horizontal distance E is calculated by multiplying the target distance D by the correction factor KF.

5. The method according to claim 4, wherein the correction factor KF is determined from a correction factor table in which a value for the degree of correction is assigned respectively to a pair of values ($D_i$, cc) representing the target distance D and a value of the elevation angle α.

6. The method according to claim 5, wherein a value of a correction factor KF(D, α) to a pair of values (D, α) representing a value of the target distance D and a value of the elevation angle α is calculated by an interpolation on the basis of the correction factors $KF_{ij}$ from the correction factor table.

7. The method according to claim 5, wherein in order to determine the value of the correction factor $KF_{ij}$ from the correction factor table, values for the correction factors KF are calculated by means of a ballistics program from data pertaining to the cartridge load of an ammunition type and a mean value is derived from values of correction factors KF to different cartridge loads respectively.

8. The method according to claim 1, wherein the correction function includes a correction factor table, and at least three different cartridge loads are used to determine the correction factor table.

9. The method according to claim 1, wherein a weighted averaging of values is applied.

10. The method according to claim 9, wherein the weighting depends on the target distance D.

11. The method according to claim 9, wherein the weighting depends on the flatness number of the projectile.

12. The method according to claim 9, wherein in order to run the weighted averaging of values, contributions from cartridge loads with a high flatness number are weighted more highly and contributions form cartridge loads with a relatively low flatness number are weighted lower.

13. The method according to claim 1, wherein environmental parameters, in particular air pressure, air humidity or temperature, are also taken into account in the correction.

14. A method of determining a replacement distance to be taken into account instead of the target distance D when taking aim on a target with a target distance D and an elevation angle α between a line of sight to the target and a horizontal plane with a weapon which has been zeroed on the horizontal with a view to firing projectiles with an approximately flat trajectory, wherein the replacement distance is determined by applying a correction function to the target distance D wherein the correction function depends not on the ballistic coefficient and the muzzle velocity of the used ammunition, rather the correction function is dependent on the target distance D and elevation angle α.

15. A method of determining a replacement distance between a location and a point of impact of a projectile in a same horizontal plane as the location, whereby a target distance D between the location and a target disposed on a line of sight is determined, and whereby an elevation angle α subtended by the line of sight and the horizontal plane is determined, wherein a correction function is determined from the target distance D and the elevation angle α wherein the correction function is not dependent on the ballistic coefficient and the muzzle velocity of used ammunition, rather the target distance D is changed by applying the correction function to it in order to fix the replacement distance in the horizontal plane.

16. The method according to claim 15, wherein the projectile has an approximately flat trajectory.

17. A device for determining a replacement distance between a location and a point of impact of a projectile in a same horizontal plane as the location for taking aim at a target in order to take a shot at an angle from an elevation angle α, with a display for a value of the replacement distance, wherein the device comprises: a distance meter for measuring a target distance D, an inclination sensor for measuring the elevation angle α between a line of sight to the target and the horizontal plane, and a microprocessor configured to calculate the replacement distance by applying a correction function to the target distance D, the microprocessor retrieves a value for the degree of the correction function from a memory, and a value for the degree of the correction function is assigned respectively to a pair of values ($D_i$, $\alpha_j$) representing a value of the target distance $D_i$ and a value of the elevation angle $\alpha_j$.

18. The device according to claim 17, wherein the microprocessor is configured to calculate the replacement distance by multiplying the target distance D by a correction factor KF.

19. The device according to claim 18, wherein the microprocessor is configured to determine the correction factor KF from a correction factor table in which a value of the correction factor $KF_{ij}$ is assigned respectively to pairs of values ($D_i$, $\alpha_j$) representing a value of the target distance D and a value of the elevation angle α.

20. The device according to claim 18, wherein a correction factor table is stored in the memory to determine values of the correction factor KF by means of a ballistics program from data pertaining to the cartridge load of an ammunition type and a mean value is derived from values of correction factors KF to different cartridge loads respectively.

21. The device according to claim 17, wherein the microprocessor is configured so that a value of a correction factor KF(D, $\alpha$) to a pair of values (D, $\alpha$) representing a value of the target distance D and a value of the elevation angle $\alpha$ is calculated by means of an interpolation on the basis of the correction factors $KF_{ij}$ from the correction factor table.

22. The device according to claim 17, wherein the distance meter comprises a laser distance meter.

23. The sight, in particular a sighting telescope, with a device for determining a replacement distance to be taken into account instead of the target distance D for taking aim on a target with the sight of a firearm according to claim 17, wherein a display of the device showing a value of the replacement distance is visible to a marksman when taking aim.

24. The sight according to claim 23, wherein the display is integrated in the visual passage, in particular in the visual optical path, of the sight.

25. The sight according to claim 23, wherein the distance meter is integrated in the visual optical path of the sight.

26. The sight according to claim 23, wherein the device for determining the replacement distance is integrated in the sight.

27. A method of determining a replacement distance between a location and a point of impact of a projectile in a horizontal plane with a weapon and a sight mounted on the weapon, whereby a relative position of a line of sight through the visual optical path of the sighting telescope relative to a barrel axis of the weapon for a pre-definable projectile is zeroed in onto a pre-definable zeroing range between the location and the point of impact of the projectile in the horizontal plane, after which the determined relative position between the line of sight and the barrel axis is detected, wherein a target distance D between the location and a target disposed on the line of sight is determined and an elevation angle $\alpha$ subtended by the line of sight and the horizontal plane is determined, and wherein a correction function is determined from the target distance D and the elevation angle $\alpha$, wherein the correction function is not dependent on the ballistic coefficient and the muzzle velocity of the used ammunition, and hence the target distance D is changed by applying the correction function to it in order to fix the replacement distance in the horizontal plane, and the relative position between the line of sight and the barrel axis is adjusted by the difference from the previously determined target distance D and re-set to the determined replacement distance.

28. The method according to claim 27, wherein the relative position between the line of sight and the barrel axis is changed by making an adjustment to the elevation turret of the sight.

29. The method according to claim 28, wherein the adjustment is made to the elevation turret of the sight electromechanically.

30. The method according to claim 28, wherein the adjustment is made to the sight automatically.

31. The method according to claim 27, wherein the relative position between the line of sight and the barrel axis is changed by taking aim with a target mark other than crosshairs corresponding to the determined replacement distance.

32. The method according to claim 27, wherein the relative position between the line of sight and the barrel axis is changed by optoelectronically adjusting the target mark in accordance with the determined replacement distance.

* * * * *

UNITED STATES PATENT AND TRADEMARK OFFICE

CERTIFICATE OF CORRECTION

PATENT NO. : 8,733,647 B2
APPLICATION NO. : 13/440191
DATED : May 27, 2014
INVENTOR(S) : Konrad A. Roider and Andreas Zimmermann It is certified that error appears in the above-identified patent and that said Letters Patent is hereby corrected as shown below:

In the claims

Column 11, line 48, "($D_i$, cc)" should read -- ($D_i$, $\alpha_j$) --

Signed and Sealed this
Twenty-first Day of June, 2016

Michelle K. Lee

Michelle K. Lee
*Director of the United States Patent and Trademark Office*